US009579918B2

(12) United States Patent
Ishimi et al.

(10) Patent No.: US 9,579,918 B2
(45) Date of Patent: Feb. 28, 2017

(54) IMAGE PROCESSING METHOD, IMAGE PROCESSING APPARATUS, AND CONVEYOR LINE SYSTEM USING IMAGE PROCESSING APPARATUS

(71) Applicants: Tomomi Ishimi, Shizuoka (JP); Shinya Kawahara, Shizuoka (JP); Toshiaki Asai, Shizuoka (JP); Katsuya Ohi, Shizuoka (JP)

(72) Inventors: Tomomi Ishimi, Shizuoka (JP); Shinya Kawahara, Shizuoka (JP); Toshiaki Asai, Shizuoka (JP); Katsuya Ohi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/075,110

(22) Filed: Mar. 19, 2016

(65) Prior Publication Data

US 2016/0271990 A1 Sep. 22, 2016

(30) Foreign Application Priority Data

Mar. 20, 2015 (JP) ..... 2015-057032

(51) Int. Cl.
*B41J 2/47* (2006.01)
*B41J 2/475* (2006.01)
(Continued)

(52) U.S. Cl.
CPC ..... *B41M 7/0009* (2013.01); *B41J 2/32* (2013.01); *B41J 2/47* (2013.01); *B41J 2/4753* (2013.01); *B41M 5/305* (2013.01); *B41J 2202/37* (2013.01)

(58) Field of Classification Search
CPC ..... B41J 2/315; B41J 2/32; B41J 2/47; B41J 2/473; B41J 2/4753; B41J 2202/37;
(Continued)

(56) References Cited

U.S. PATENT DOCUMENTS 6,633,319 B1 * 10/2003 Yamakawa ..... B41J 2/473 347/172
7,439,993 B2 * 10/2008 Ishimi ..... B41J 2/471 347/179

(Continued)

FOREIGN PATENT DOCUMENTS

JP 11-151856 6/1999
JP 2000-136022 5/2000

(Continued)

*Primary Examiner* — Anh T. N. Vo
(74) *Attorney, Agent, or Firm* — Cooper & Dunham LLP

(57) ABSTRACT

Provided is an image processing method, the method including heating a thermoreversible recording medium with laser beams to erase an image which has been recorded on the thermoreversible recording medium, the thermoreversible recording medium reversibly changing between a colored state and a decolored state depending on a heating temperature and a cooling time; heating the thermoreversible recording medium, on which the image has been erased, with the laser beams to record a subsequent image on the thermoreversible recording medium; and measuring at least one of a surface temperature of the thermoreversible recording medium and a recording environmental temperature after a completion of erasing the image but before a beginning of recording the subsequent image to obtain a measured temperature value and controlling a time interval between the completion of erasing the image and the beginning of recording the subsequent image depending on the measured temperature value.

16 Claims, 3 Drawing Sheets

(51) Int. Cl.
*B41M 7/00* (2006.01)
*B41M 5/30* (2006.01)
*B41J 2/32* (2006.01)

(58) Field of Classification Search
CPC . B41J 2202/4756; G02B 26/10; B41M 5/305; B41M 7/0009
See application file for complete search history.

(56) References Cited

U.S. PATENT DOCUMENTS

| | | | | |
|---|---|---|---|---|
| 7,728,860 | B2 * | 6/2010 | Kawahara | B41J 2/315 347/224 |
| 8,284,222 | B2 * | 10/2012 | Ishimi | B41J 2/473 347/179 |
| 8,358,325 | B2 | 1/2013 | Asai et al. | |
| 8,471,885 | B2 | 6/2013 | Ishimi et al. | |
| 8,598,074 | B2 | 12/2013 | Kawahara et al. | |
| 8,633,958 | B2 | 1/2014 | Kawahara et al. | |
| 8,643,689 | B2 | 2/2014 | Ishimi et al. | |
| 8,665,496 | B2 | 3/2014 | Hasegawa et al. | |
| 8,933,981 | B2 | 1/2015 | Yamamoto et al. | |
| 9,090,105 | B2 | 7/2015 | Ishikake et al. | |
| 2007/0225162 | A1 | 9/2007 | Kawahara et al. | |
| 2008/0069596 | A1 | 3/2008 | Iino et al. | |
| 2008/0192618 | A1 | 8/2008 | Nakata et al. | |
| 2012/0075402 | A1 | 3/2012 | Ishimi et al. | |
| 2012/0211673 | A1 | 8/2012 | Yamamoto | |
| 2013/0135425 | A1 | 5/2013 | Yamamoto | |
| 2013/0141512 | A1 | 6/2013 | Asai et al. | |
| 2014/0078234 | A1 | 3/2014 | Kawahara et al. | |
| 2014/0099574 | A1 | 4/2014 | Kawahara et al. | |
| 2014/0158771 | A1 | 6/2014 | Ohi et al. | |
| 2014/0285606 | A1 | 9/2014 | Ishimi et al. | |
| 2015/0080214 | A1 | 3/2015 | Yamamoto et al. | |
| 2015/0151550 | A1 | 6/2015 | Asai et al. | |

FOREIGN PATENT DOCUMENTS

| | | |
|---|---|---|
| JP | 2006-035683 | 2/2006 |
| JP | 2007-076122 | 3/2007 |
| JP | 2008-194905 | 8/2008 |
| JP | 2008-213439 | 9/2008 |
| JP | 4958506 | 3/2012 |
| JP | 5010878 | 6/2012 |
| JP | 5062838 | 8/2012 |
| JP | 5095962 | 9/2012 |
| JP | 5637189 | 10/2014 |

* cited by examiner

IMAGE PROCESSING METHOD, IMAGE PROCESSING APPARATUS, AND CONVEYOR LINE SYSTEM USING IMAGE PROCESSING APPARATUS

CROSS-REFERENCE TO RELATED APPLICATIONS

The present application claims priority under 35 U.S.C. §119 to Japanese Patent Application No. 2015-057032, filed Mar. 20, 2015. The contents of which are incorporated herein by reference in their entirety.

BACKGROUND OF THE INVENTION

Field of the Invention

The present invention relates to image processing methods, image processing apparatuses, and conveyor line systems using the image processing apparatuses.

Description of the Related Art

Recently, an image processing apparatus using a thermoreversible recording medium has been incorporated into and utilized in a conveyor line system which needs to manage a conveying container (e.g., returnable container employed in a physical distribution system). The thermoreversible recording medium is attached on the conveying container as a label and is rewritable with laser beams emitted from the image processing apparatus in a non-contact manner. This eliminates a need for attaching and peeling off a label, which makes it possible to efficiently operate the conveyor line system.

The thermoreversible recording medium contains, for example, a leuco dye and a reversible color developer. When the thermoreversible recording medium is heated to equal to or higher than a coloring temperature range in which the leuco dye and the reversible color developer melt and then rapidly cooled, the thermoreversible recording medium turns into a colored state (visible state). Meanwhile, when the thermoreversible recording medium is heated to a decoloring temperature range, which is lower than the coloring temperature range, held for a predetermined period of time, and then cooled, the thermoreversible recording medium turns into a decolored state (invisible state). However, even though the thermoreversible recording medium is heated to equal to or higher than the coloring temperature range in order to develop a color, if thermoreversible recording medium is then slowly cooled, the thermoreversible recording medium turns into the decolored state.

The thermoreversible recording medium having such property as described above is problematic in that, under a high temperature environment, the thermoreversible recording medium is decreased in coloring density since the thermoreversible recording medium which has been heated is difficult to be rapidly cooled. On the other hand, under a low temperature environment, there also is a problem that the thermoreversible recording medium is decreased in the coloring density since the thermoreversible recording medium is difficult to be held within the decoloring temperature range after the thermoreversible recording medium is heated.

In order to solve the above problems, there has been proposed a method for controlling laser beam power depending on a surface temperature of the thermoreversible recording medium (see, Japanese Unexamined Patent Application Publication No. 2008-194905).

SUMMARY OF THE INVENTION

The present invention aims to provide an image processing method which can prevent an image to be recorded from decreasing in coloring density without deteriorating throughput per day and can improve machine-readability of, for example, a barcode even when at least one of a surface temperature of a thermoreversible recording medium and a recording environmental temperature is suddenly increased to an unexpected level.

An image processing method according to the present invention as a means for solving the above problems includes an image erasing step, an image recording step, and a controlling step. The image erasing step is a step of heating a thermoreversible recording medium with laser beams to erase an image which has been recorded on the thermoreversible recording medium. The thermoreversible recording medium reversibly changes between a colored state and a decolored state depending on a heating temperature and a cooling time. The image recording step is a step of heating the thermoreversible recording medium, on which the image has been erased, with the laser beams to record a subsequent image on the thermoreversible recording medium. The controlling step is a step of measuring at least one of a surface temperature of the thermoreversible recording medium and a recording environmental temperature after a completion of erasing the image but before a beginning of recording the subsequent image to obtain a measured temperature value and controlling a time interval between the completion of erasing the image and the beginning of recording the subsequent image depending on the measured temperature value.

According to the present invention, there can be provided an image processing method which can prevent an image to be recorded from decreasing in coloring density without deteriorating throughput per day and can improve machine-readability of, for example, a barcode even when at least one of a surface temperature of a thermoreversible recording medium and a recording environmental temperature is suddenly increased to an unexpected level.

Figure 1:
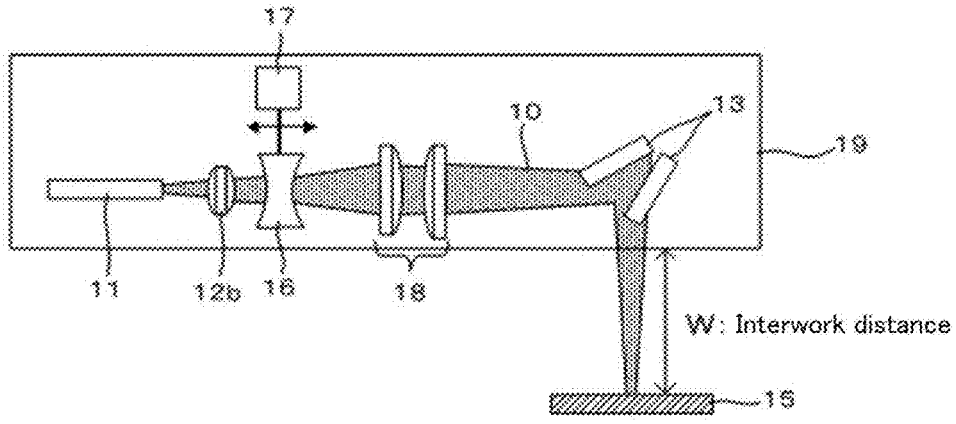
FIG. 1 is a schematic diagram illustrating one exemplary image processing apparatus according to the present invention.

DETAILED DESCRIPTION OF THE INVENTION (Image Processing Method and Image Processing Apparatus)

An image processing method includes heating a thermoreversible recording medium with laser beams to erase an image which has been recorded on the thermoreversible recording medium, the thermoreversible recording medium reversibly changing between a colored state and a decolored state depending on a heating temperature and a cooling time;

heating the thermoreversible recording medium, on which the image has been erased, with the laser beams to record a subsequent image on the thermoreversible recording medium; and measuring at least one of a surface temperature of the thermoreversible recording medium and a recording environmental temperature after a completion of erasing the image but before a beginning of recording the subsequent image to obtain a measured temperature value and controlling a time interval between the completion of erasing the image and the beginning of recording the subsequent image depending on the measured temperature value.

An image processing apparatus includes a laser beam emitting unit configured to irradiate a thermoreversible recording medium with the laser beams to heat the thermoreversible recording medium, to perform at least one of erasing an image which has been recorded on the thermoreversible recording medium and recording a subsequent image on the thermoreversible recording medium, the thermoreversible recording medium reversibly changing between a colored state and a decolored state depending on a heating temperature and a cooling time; a laser beam scanning unit configured to scan the laser beams to perform at least one of erasing the image which has been recorded on the thermoreversible recording medium and recording the subsequent image on the thermoreversible recording medium; and a control unit configured to measure at least one of a surface temperature of the thermoreversible recording medium and a recording environmental temperature after a completion of erasing the image but before a beginning of recording the subsequent image to obtain a measured temperature value and control a time interval between the completion of erasing the image and the beginning of recording the subsequent image depending on the measured temperature value.

The image processing method is based on the following finding that there is a limit in the method described in Japanese Unexamined Patent Application Publication No. 2008-194905 as described below in order to prevent coloring density from decreasing only by controlling the laser beam power.

The conveyor line system is often located in, for example, a platform in a truck terminal exposed to the air, where an ambient temperature tends to be high during the daytime in summer and a recording environmental temperature may suddenly be increased to an unexpected level due to heat, which is generated from a motor, accumulated within a laser beam shielding cover through continuous operation of a conveyer. Specifically, when a temperature inside the laser beam shielding cover was measured in summer (August), the temperature was higher than 35° C. in a range of from 1% through 10% of the period of time from Noon (12:00) through 3:00 PM (15:00).

Additionally, there is a need for the conveyor line system to achieve high throughput per day. Therefore, a time interval between the completion of erasing an image which has been recorded and the beginning of recording a new image needs to be shortened. Then, the new image should be recorded immediately after the thermoreversible recording medium is irradiated with laser beams for erasing the image to accumulate heat therein in order to erase an image, so that the thermoreversible recording medium is much less likely to be cooled rapidly.

The image processing method includes the image erasing step, the image recording step, and the controlling step which is a step of controlling the time interval between the completion of the image erasing step and the beginning of the image recording step; and, if necessary, further includes appropriately selected other steps.

The image processing method may be suitably performed using the image processing apparatus.

The image processing apparatus according to the present invention includes an image processing section into which an image erasing section configured to perform the image erasing step and an image recording section configured to perform the image recording step are integrated; and, if necessary, further includes appropriately selected other sections.

Note that, the image erasing section and the image recording section of the image processing apparatus may be separate apparatuses. However, the image processing section is preferable since an image can be erased and recorded at one laser beam emitting position and the time it takes for which the conveying container is conveyed from the image erasing section to the image recording section can be shortened, in response to the demand for a shortened rewriting processing time.

<Image Processing Section>

The image processing section includes a laser beam emitting unit, a laser beam scanning unit, and a control unit; preferably includes a focal length control unit; and, if necessary, further includes other units such as a distance measuring unit and a temperature measuring unit.

<<Laser Beam Emitting Unit>>

The laser beam emitting unit is not particularly limited and may be appropriately selected depending on the intended purpose, but is preferably a fiber-coupled laser diode since it can easily form a top-hat shaped light intensity distribution and can record an image with high visibility.

In order to record an image with high visibility, it is necessary to uniformize a light intensity distribution of laser beams. Typical laser beams have light intensity of Gaussian distribution, that is, have higher intensity at a central portion. When the thermoreversible recording medium is irradiated with such laser beams to record an image, a peripheral portion has lower contrast than that of the central portion, resulting in poor visibility. However, the fiber-coupled laser diode from which laser beams with the top-hat shaped light intensity distribution are emitted enables an image with high visibility to be recorded.

In the case of using the typical laser beams having light intensity of Gaussian distribution, a spot diameter is increased while keeping Gaussian distribution as the focal point is away from the thermoreversible recording medium in an optical axis direction. Thus, an image is recorded with a thicker line on the thermoreversible recording medium. In the case of using laser beams emitted from the fiber-coupled laser diode, the spot diameter is also increased as the focal point is away from the thermoreversible recording medium in the optical axis direction. However, a diameter at the central portion with higher intensity is not increased since the light intensity distribution approaches Gaussian distribution. Thus, a line width is less likely to be thick upon image recording.

Therefore, in the case where the focal point is away from the thermoreversible recording medium in the optical axis direction, laser beams emitted from the fiber-coupled laser diode is less likely to vary in energy for irradiating the thermoreversible recording medium than laser beam emitted from the typical laser. As a result, the fiber-coupled laser diode enables an image to be recorded on the thermoreversible recording medium with relatively stable contrast and line width, and high visibility.

Emitting power of laser beams to be emitted from the laser beam emitting unit is not particularly limited and may be appropriately selected depending on the intended purpose, so long as it can be controlled in accordance with instructions from the control unit. Therefore, a laser beam emitting unit capable of operating in a pulsed oscillation mode is preferably used since the emitting power can be easily controlled by varying at least one of a pulse period and a pulse duty ratio.

A wavelength of laser beams to be emitted from the laser beam emitting unit is not particularly limited and may be appropriately selected depending on the intended purpose, but the lower limit thereof is preferably 700 nm or longer, more preferably 720 nm or longer, particularly preferably 750 nm or longer. The laser beams having the lower limit of the wavelength falling within the above described preferable range are advantageous in that, in the visible light region, an image is not easily decreased in contrast upon recording on the thermoreversible recording medium, and the thermoreversible recording medium is less likely to be colored. In the ultraviolet region having shorter wavelengths, the thermoreversible recording medium is advantageously less likely to be deteriorated. The upper limit of the wavelength of the laser beams is preferably 1,600 nm or shorter, more preferably 1,300 mm or shorter, particularly preferably 1,200 nm or shorter. The laser beams having the upper limit of the wavelength falling within the above described preferable range are advantageous in that there is no need for a photothermal converting material having a high decomposition temperature and absorbing light having longer wavelengths in the case where an organic pigment is added to the thermoreversible recording medium as the photothermal converting material.

<<Laser Beam Scanning Unit>>

The laser beam scanning unit is not particularly limited and may be appropriately selected depending on the intended purpose, so long as it can scan laser beams, which is emitted from the laser beam emitting unit, over the thermoreversible recording medium. Examples thereof include a combination of a galvanometer and a mirror mounted on the galvanometer.

<<Focal Length Control Unit>>

The focal length control unit preferably includes a lens system which is disposed between the laser beam emitting unit and the laser beam scanning unit and which is configured to be able to adjust a focal point of the laser beams. The focal length control unit is preferably configured to control a position of the lens system so as to defocus on a position of the thermoreversible recording medium upon image erasing and so as to focus on a position of the thermoreversible recording medium upon image recording.

The focal length control unit is configured to control a position of the lens system based on a distance between the thermoreversible recording medium and a laser beam emitting surface of the laser beam emitting unit (hereinafter referred to as "interwork distance") which has been measured by the distance measuring unit. The focal length control unit is configured to control the position of the lens system so as to defocus the laser beams on a position of the thermoreversible recording medium upon image erasing and so as to focus the laser beams on a position of the thermoreversible recording medium upon image recording.

<<Distance Measuring Unit>>

The distance measuring unit is not particularly limited and may be appropriately selected depending on the intended purpose, so long as it can measure the interwork distance. For example, it may be a ruler (scale) or a distance sensor.

Examples of the distance sensor include a non-contact distance sensor and a contact distance sensor. The contact distance sensor damages the thermoreversible recording medium to be measured and is difficult to measure the distance rapidly. Thus, the non-contact distance sensor is preferable. Among the non-contact distance sensors, a laser displacement sensor is preferable since it can rapidly and accurately measure the distance, and is inexpensive and small-sized.

Among the laser displacement sensors, in the case where the position of the lens system of the focal length control unit is corrected based on the interwork distance which has been measured, a laser displacement sensor capable of transmitting the measured result to the image processing apparatus (e.g., a laser displacement sensor manufactured by Panasonic Corporation) is preferable.

As for a position to be measured by the distance sensor and the number thereof, in the case where the thermoreversible recording medium is relatively flat, one position at a central portion of the thermoreversible recording medium corresponding to an average distance from the thermoreversible recording medium to the distance sensor is preferably measured from the viewpoints of simplified processing and high cost performance. On the other hand, in the case where the thermoreversible recording medium is greatly inclined, a plurality of positions are needed to be measured. Three or more positions are preferably measured. In this case, a three-dimensional incline of the thermoreversible recording medium is calculated based on the measured results at three or more positions to thereby correct the focal length.

<<Temperature Measuring Unit>>

The temperature measuring unit is not particularly limited and may be appropriately selected depending on the intended purpose, so long as it can measure at least one of the surface temperature of the thermoreversible recording medium and the recording environmental temperature.

The recording environmental temperature refers to a temperature measured after an image is erased but immediately before a subsequent image is recorded. An erasing environmental temperature refers to a temperature measured immediately before an image is erased. Note that, an environment under which the thermoreversible recording medium is irradiated with laser beams is inside the laser beam shielding cover disposed adjacent to the image processing apparatus.

The temperature measuring unit is not particularly limited and may be appropriately selected depending on the intended purpose, and examples thereof include a temperature sensor.

Examples of the temperature sensor include a surface temperature sensor and an environmental temperature sensor.

The surface temperature sensor is not particularly limited and may be appropriately selected depending on the intended purpose, so long as it can measure a surface temperature of the thermoreversible recording medium, but is preferably a radiation thermometer because it can measure the temperature in a non-contact manner.

The environmental temperature sensor is not particularly limited and may be appropriately selected depending on the intended purpose, so long as it can measure at least the recording environmental temperature of the erasing environmental temperature and the recording environmental temperature, but is preferably a thermistor because it can be used at low costs and can rapidly and accurately measure the temperature.

<<Control Unit>>

The control unit includes a time interval controller configured to measure at least one of the surface temperature of the thermoreversible recording medium and the recording environmental temperature after the completion of the image erasing step but before the beginning of the image recording step to obtain a measured temperature value and to perform a temperature-based correction of the time interval in the image recording step depending on the measured temperature value. The control unit preferably further includes an irradiating energy controller configured to perform a temperature-based correction of the irradiating energy of laser beams.

The control unit may also be configured to perform a temperature-based correction of the irradiating energy of laser beams to be emitted in the image erasing step depending on at least one of the surface temperature of the thermoreversible recording medium and the erasing environmental temperature measured by the temperature measuring unit before the beginning of the image erasing step.

Note that, the control unit was described to measure at least one of the surface temperature of the thermoreversible recording medium and the temperature of a spatial environment (the recording environmental temperature or the erasing environmental temperature) to obtain a measured temperature value and to perform the temperature-based correction, but not limited thereto. The surface temperature of the thermoreversible recording medium may be preferentially used since a position which is actually irradiated with laser beams can be measured accurately. Alternatively, both of the surface temperature of the thermoreversible recording medium and the temperature of the spatial environment may be measured and compared with each other to thereby determine which temperature is used.

After the thermoreversible recording medium is heated in the image erasing step, a temperature of the thermoreversible recording medium varies over time through heat dissipation until immediately before the image recording step. Therefore, the irradiating energy of laser beams upon the image recording can also be corrected based on the temperature measured upon the image erasing and the time interval between the completion of the image erasing step and the beginning of the image recording step. This eliminates temperature measurement upon the image recording, so that processing time is shortened and there is no need to mount a sensor on the image processing apparatus.

The temperature-based correction of the irradiating energy is not particularly limited and may be appropriately selected depending on the intended purpose. For example, the control unit may calculate the emitting power of laser beams based on the measured temperature value and instruct the laser beam emitting unit to record an image at the emitting power calculated above. Specifically, the irradiating energy is corrected so that the emitting power is decreased at a high measured temperature value or the emitting power is increased at a low measured temperature value. Thus, the temperature-based correction of the irradiating energy is performed.

When the time interval between the completion of the image erasing step and the beginning of the image recording step is short, the irradiating energy of laser beams is set to be low.

<<Other Units>>

The other units are not particularly limited and may be appropriately selected depending on the intended purpose. For example, an apparatus control unit may be used.

The apparatus control unit is not particularly limited and may be appropriately selected depending on the intended purpose, so long as it can entirely control the image processing apparatus and can control the operation of each of the above steps and units. Examples thereof include devices such as a sequencer and a computer. Note that, the apparatus control unit may be included in the control unit.

<Other Sections>

The image processing apparatus has the same basic configuration as commonly used laser marker devices. Therefore, examples of the other sections include a power supply control section and a program section.

The power supply control section includes a power supply for driving a light source for exciting a laser medium, a power supply for driving a galvanometer, and a power supply for cooling, for example, a Peltier-element.

The program section includes an information setting unit such as touch panel and a key board. The program section is configured to input conditions such as an irradiating area, emitting power and scanning velocity of laser beams and to create and edit, for example, characters to be recorded for image recording and erasing.

Note that, the image processing apparatus also includes, for example, a conveyer for the thermoreversible recording medium, a controller for the conveyer, and a monitor (touch panel).

<Image Erasing Step>

The image erasing step is not particularly limited and may be appropriately selected depending on the intended purpose, so long as it can irradiate the thermoreversible recording medium with laser beams to heat the thermoreversible recording medium, to thereby erase an image which has been recorded on the thermoreversible recording medium. The irradiating energy of the laser beams to be emitted during the image erasing step and a heating time by the laser beams are subjected to the temperature-based correction by the control unit.

<Image Recording Step>

The image recording step is not particularly limited and may be appropriately selected depending on the intended purpose, so long as it can irradiate the thermoreversible recording medium with laser beams to heat the thermoreversible recording medium, to thereby record an image. The irradiating energy of laser beams to be emitted during the image recording step and the time interval are subjected to the temperature-based correction by the control unit.

<Controlling Step>

The controlling step is a step of performing the temperature-based correction of the time interval and preferably further performing a temperature-based correction of the irradiating energy Ew of laser beams to be emitted to the thermoreversible recording medium upon the image recording.

The control unit preferably further includes controlling the emitting power of laser beams to be emitted for recording a new image on the thermoreversible recording medium depending on the measured temperature value.

The controlling step preferably further includes controlling the emitting power of laser beams to be emitted for recording a new image on the thermoreversible recording medium depending on the time interval between the completion of the image erasing step and the beginning of the image recording step.

The controlling step includes the temperature-based correction of the irradiating energy and the temperature-based correction of the time interval; and, if necessary, further includes other processing.

The controlling step may be suitably performed by the control unit. The controlling step includes the temperature-based correction of the irradiating energy of laser beams to be emitted in the image erasing step, the temperature-based correction of the time interval, and the temperature-based correction of the irradiating energy of laser beams to be emitted in the image recording step; and, if necessary, further includes other processing. Note that, these temperature-based corrections are performed at proper timing for each correction.

<<Temperature-Based Correction of Irradiating Energy of Laser Beams to be Emitted in Image Erasing Step>>

The temperature-based correction of the irradiating energy of laser beams to be emitted in the image erasing step is not particularly limited and may be appropriately selected depending on the intended purpose. However, the temperature-based correction preferably includes measuring at least one of the surface temperature of the thermoreversible recording medium and the erasing environmental temperature to obtain a measured temperature value and correcting the irradiating energy depending on the measured temperature value.

The irradiating energy Ee of laser beams to be emitted in the image erasing step can be expressed as $Ee=(Pe\times re)/Ve$. The Pe, re, and Ve can be controlled to vary to thereby perform the correction.

Note that, Pe denotes emitting power of laser beams to be emitted in the image erasing step, Ve denotes scanning velocity of laser beams to be emitted in the image erasing step, and re denotes a spot diameter of laser beams to be emitted in the image erasing step.

A method for controlling the emitting power Pe is not particularly limited and may be appropriately selected depending on the intended purpose. Examples thereof include adjustment of peak power of laser beams, and adjustment of at least one of a pulse period and a pulse duty ratio in the case of pulsed laser irradiation.

Specifically, the temperature-based correction of the irradiating energy is performed by determining a correction amount of the pulse duty ratio from a temperature difference between the measured temperature value measured before the beginning of the image erasing step and the reference temperature of 25° C. using a correction factor of −0.9%/° C. and adjusting the emitting power Pe of laser beams based on the correction amount. For example, in the case of the measured temperature value of 35° C., the temperature difference from the reference temperature of 25° C. was +10° C., so that the correction amount of the pulse duty ratio was determined as −9.0%. Then, laser beams are emitted at the pulse duty ratio of 71.0% which was determined by multiplying the setting value of the pulse duty ratio at 25° C. of 78.0% by 0.91.

The emitting power Pe is not particularly limited and may be appropriately selected depending on the intended purpose. However, the lower limit thereof is preferably 5 W or greater, more preferably 7 W or greater, particularly preferably 10 W or greater. The emitting power Pe falling within the above described preferable range is advantageous in that an image can be erased in a shorter time and the emitting power Pe can be obtained sufficiently even in the shorter time and erasion failure is less likely to occur. The upper limit thereof is preferably 200 W or lower, more preferably 150 W or lower, particularly preferably 100 W or lower. The emitting power Pe falling within the above described preferable range is advantageous in that the image processing apparatus may not need to be upsized.

A method for controlling the scanning velocity Ve is not particularly limited and may be appropriately selected depending on the intended purpose. Examples thereof include a method in which the rotation speed of a motor for driving a scanning mirror in the laser beam scanning unit is controlled.

The scanning velocity Ve is not particularly limited and may be appropriately selected depending on the intended purpose. However, the lower limit thereof is preferably 100 mm/s or higher, more preferably 200 mm/s or higher, particularly preferably 300 mm/s or higher. The scanning velocity Ve falling within the above described preferable range advantageous in terms of rapid image erasing. The upper limit thereof is preferably 20,000 mm/s or lower, more preferably 15,000 mm/s or lower, particularly preferably 10,000 mm/s or lower. The scanning velocity Ve falling within the above described preferable range is advantageous in terms of uniform image erasing.

A method for controlling the spot diameter re is not particularly limited and may be appropriately selected depending on the intended purpose. Examples thereof include a method in which the focal length control unit is used to control the focal length to defocus.

The spot diameter re is not particularly limited and may be appropriately selected depending on the intended purpose. However, the lower limit thereof is preferably 1 mm or larger, more preferably 2 mm or larger, particularly preferably 3 mm or larger. The spot diameter re falling within the above described preferable range is advantageous in that the heating time for erasing an image can be ensured to thereby allow the image to be erased at a low temperature and the image can be erased in a shorter time. The upper limit thereof is preferably 20 mm or smaller, more preferably 16 mm or smaller, particularly preferably 12 mm or smaller. The spot diameter re falling within the above described preferable range is advantageous in that the heating time for erasing an image can be ensured to easily control the irradiating energy Ee at a low level and erasion failure is less likely to occur.

A pitch width for scanning laser beams is not particularly limited and may be appropriately selected depending on the intended purpose. However, the upper limit thereof is preferably 6 mm or shorter, more preferably 4 mm or shorter, particularly preferably 3 mm or shorter. The lower limit thereof is preferably 0.3 mm or longer, more preferably 0.5 mm or longer, particularly preferably 0.8 mm or longer. The pitch width falling within the above described preferable range is advantageous in that the heating time for erasing an image can be properly controlled, erasing energy required to erase the image can be decreased, and the image can be erased in a shorter time.

<<Temperature-Based Correction of Irradiating Energy of Laser Beams to be Emitted in Image Recording Step>>

For example, in the case where an image is just recorded on the thermoreversible recording medium, a heated portion of the thermoreversible recording medium which has been irradiated with laser beams is rapidly cooled through heat dissipation to a surrounding region. Meanwhile, even when the thermoreversible recording medium is irradiated with laser beams to be emitted for erasing the image, in the case where a heated portion of the thermoreversible recording medium is irradiated with laser beams to be emitted for recording an image after the heat dissipation, the heated portion is rapidly cooled through heat dissipation to a surrounding region.

However, in the case where a new image is recorded immediately after the thermoreversible recording medium is irradiated with laser beams to be emitted for erasing an image, heat applied during the image erasing may be accumulated in the thermoreversible recording medium. When image starts to be recorded with heat being accumulated in the thermoreversible recording medium, the thermoreversible recording medium is less likely to be cooled rapidly to thereby decrease coloring density, potentially leading to poor barcode readability. The shorter the rewriting processing time is (i.e., the shorter the time interval between the completion of the image erasing step and the beginning of the image recording step is), the more frequently the coloring density decreases.

In the case where an image is recorded at a constant emitting power of laser beams, the irradiating energy of the laser beams needs to be set at a high level in order to obtain sufficient image density even at a region with the least accumulated heat. When an image is recorded on a region with much accumulated heat at high irradiating energy, the thermoreversible recording medium is excessively heated to potentially cause the following phenomena: deteriorated durability for repeated use, deteriorated readability of, for example, a barcode, and a smudged character and symbol.

The shorter the rewriting processing time is (i.e., the shorter the time interval between the completion of the image erasing step and the beginning of the image recording step is), the more frequently these phenomena occur.

Therefore, in the case where at least one of the surface temperature of the thermoreversible recording medium and the recording environmental temperature is increased to make it difficult to dissipate heat, the irradiating energy of laser beams to be emitted for recording and image needs to be corrected based on the temperature.

The temperature-based correction of the irradiating energy of laser beams to be emitted in the image recording step is not particularly limited and may be appropriately selected depending on the intended purpose. However, the temperature-based correction preferably includes measuring at least one of the surface temperature of the thermoreversible recording medium and the recording environmental temperature during the period from the completion of the image erasing step to the beginning of the image recording step to obtain a measured temperature value and correcting the irradiating energy depending on the measured temperature value.

The irradiating energy Ew of laser beams to be emitted in the image recording step can be expressed as $Ew=(Pw\times rw)/Vw$ in the same manner as the irradiating energy Ee. The Pw, rw, and Vw can be controlled to vary to thereby perform the correction.

Note that, Pw denotes emitting power of laser beams to be emitted in the image recording step, Vw denotes scanning velocity of laser beams to be emitted in the image recording step, and rw denotes a spot diameter of laser beams to be emitted in the image recording step.

A method for controlling the emitting power Pw is not particularly limited and may be appropriately selected depending on the intended purpose. Examples thereof include adjustment of peak power of laser beams, and adjustment of at least one of a pulse period and a pulse duty ratio in the case of pulsed laser irradiation.

Specifically, the temperature-based correction of the irradiating energy Ew in the image recording step is performed by determining a correction amount of the pulse duty ratio from a temperature difference between the measured temperature value and the reference temperature of 25° C. using a correction factor of −0.4%/° C. and adjusting the emitting power Pw of laser beams based on the correction amount. For example, in the case of the measured temperature value of 35° C., the temperature difference from the reference temperature of 25° C. was +10° C., so that the correction amount of the pulse duty ratio was determined as −4.0%. Then, laser beams are emitted at the pulse duty ratio of 25.9% which was determined by multiplying 27.0% by 0.96 assuming that the setting value of the pulse duty ratio at 25° C. is 27.0%.

The emitting power Pw is not particularly limited and may be appropriately selected depending on the intended purpose. However, the lower limit thereof is preferably 1 W or greater, more preferably 3 W or greater, particularly preferably 5 W or greater. The emitting power Pw falling within the above described preferable range is advantageous in that an image can be erased in a shorter time and the emitting power can be obtained sufficiently even in the shorter time. The upper limit thereof is preferably 200 W or lower, more preferably 150 W or lower, particularly preferably 100 W or lower. The emitting power Pw falling within the above described preferable range is advantageous in that the image processing apparatus may not need to be upsized.

A method for controlling the scanning velocity Vw is not particularly limited and may be appropriately selected depending on the intended purpose. Examples thereof include a method in which the rotation speed of a motor for driving a scanning mirror in the laser beam scanning unit is controlled.

The scanning velocity Vw is not particularly limited and may be appropriately selected depending on the intended purpose. However, the lower limit thereof is preferably 300 mm/s or higher, more preferably 500 mm/s or higher, particularly preferably 700 mm/s or higher. The scanning velocity Vw falling within the above described preferable range is advantageous in that an image can be recorded in a short time. The upper limit thereof is preferably 15,000 mm/s or lower, more preferably 10,000 mm/s or lower, particularly preferably 8,000 mm/s or lower. The scanning velocity Vw falling within the above described preferable range is advantageous in that the scanning velocity Vw can be easily controlled and a uniform image can be easily formed.

A method for controlling the spot diameter rw is not particularly limited and may be appropriately selected depending on the intended purpose. Examples thereof include a method in which the focal length control unit is used to control the focal length to defocus.

The spot diameter rw is not particularly limited and may be appropriately selected depending on the intended purpose. However, the lower limit thereof is preferably 0.02 mm or longer, more preferably 0.1 mm or longer, particularly preferably 0.15 mm or longer. The spot diameter rw falling within the above described preferable range is advantageous in that an image can be prevented from being recorded with thinner lines, so that visibility is less likely to decrease. The upper limit thereof is preferably 2.0 mm or shorter, more preferably 1.5 mm or shorter, particularly preferably 1.0 mm or shorter. The spot diameter rw falling within the above described preferable range is advantageous in that an image can be prevented from easily being recorded with thicker lines and adjacent lines are not overlaid, enabling a small-sized image to be recorded.

The temperature-based correction of the irradiating energy may be performed for not only the irradiating energy Ew upon the image recording, but also the irradiating energy Ee upon the image erasing depending on at least one of the surface temperature of the thermoreversible recording medium and the erasing environmental temperature before the image erasing step measured before the image erasing step.

Specifically, the temperature-based correction of the irradiating energy is performed by determining a correction amount of the pulse duty ratio from a temperature difference between the measured temperature value measured before the beginning of the image erasing step and the reference temperature of 25° C. using a correction factor of −0.9%/° C. and adjusting the emitting power Pe of laser beams based on the correction amount. For example, in the case of the measured temperature value of 35° C., the temperature difference from the reference temperature of 25° C. was +10° C., so that the correction amount of the pulse duty ratio was determined as −9.0%. Then, laser beams are emitted at the pulse duty ratio of 71.0% which was determined by multiplying the setting value of the pulse duty ratio at 25° C. of 78.0% by 0.91.

<<Temperature-Based Correction of Time Interval>>

The temperature-based correction of the time interval is performed by controlling the time interval between the completion of the image erasing step and the beginning of the image recording step using, for example, a clock in the image processing apparatus.

The lower limit of the time interval in the case of the measured temperature value of 35° C. or higher is not particularly limited and may be appropriately selected depending on the intended purpose, but is preferably 400 ms or longer, more preferably 500 ms or longer, particularly preferably 600 ms or longer. The time interval falling within the above described preferable range is advantageous in that the heat accumulated in the thermoreversible recording medium during the image erasing is easily dissipated even when the temperature is suddenly increased to an unexpected level, and deteriorated coloring density, deteriorated readability of an optical information code, deteriorated durability for repeated use, and a smudged character and symbol are less likely to occur. The upper limit of the time interval is not particularly limited and may be appropriately selected depending on the intended purpose, but is preferably 1,000 ms or shorter. The time interval falling within the above described preferable range is advantageous in that the image processing apparatus can keep its high throughput.

Note that, upon image recording, heat is more likely to be accumulated in the thermoreversible recording medium in the case of an image composed of a plurality of laser-drawn lines adjacent to each other (e.g., a thick character, an outline character, an optical information code, and a solid image) than an image composed of a single line which is not adjacent to any other line (e.g., a character and a symbol).

This is because the heated portions are denser in the image composed of a plurality of laser-drawn lines adjacent to each other than the character or symbol composed of a single line, so that the heat dissipation to a surrounding area is slower. Thus, the thermoreversible recording medium is likely to slowly cooled and excessively heated.

As a result, the temperature-based correction of the irradiating energy and the time interval may be performed based on a rate of the plurality of laser-drawn lines adjacent to each other in an image to be recorded.

<Other Steps>

The other steps are not particularly limited and may be appropriately selected depending on the intended purpose. Examples thereof include an apparatus control step.

The apparatus control step is a step of controlling each of the above steps and may be suitably performed by the apparatus control unit.

<Thermoreversible Recording Medium>

A shape, structure, and size of the thermoreversible recording medium are not particularly limited and may be appropriately selected depending on the intended purpose.

The thermoreversible recording medium includes a support, a thermoreversible recording layer on the support; and, if necessary, may further include appropriately selected other layers, such as a hollow layer, a first oxygen barrier layer, a photothermal converting layer, a second oxygen barrier layer, a UV ray absorbing layer, a back layer, a protective layer, an intermediate layer, an under layer, an adhesive layer, a bonding agent layer, a coloring layer, an air layer, and a light reflective layer. Each of these layers may have a single layer structure or a laminate structure. However, in order to reduce energy loss of the laser beams having a certain wavelength to be emitted, a layer disposed on the photothermal converting layer is preferably composed of a material that is less likely to absorb light having the certain wavelength.

One aspect of a layer configuration of the thermoreversible recording medium includes the hollow layer and the thermoreversible recording layer on (the support+the first oxygen barrier layer), and further includes the intermediate layer, the second oxygen barrier layer, and the UV ray absorbing layer in this order on the thermoreversible recording layer.

—Support—

A shape, structure, and size of the support are not particularly limited and may be appropriately selected depending on the intended purpose. Examples of the shape include a plate shape. The structure may be a single layer structure or a laminate structure. The size may be appropriately selected depending on the size of the thermoreversible recording medium.

—Thermoreversible Recording Layer—

The thermoreversible recording layer contains a leuco dye, which is an electron-donating coloring compound, and a reversible color developer, which is an electron-accepting compound. The thermoreversible recording layer is a configured to reversibly change in its color tone depending on a heating temperature and a cooling time after heating. The thermoreversible recording layer contains a binder resin and a photothermal converting material; and, if necessary, may further contain other components.

The leuco dye, which is an electron-donating coloring compound that reversibly changes in its color tone upon application of heat, and the reversible color developer, which is an electron-accepting compound, are materials which can realize reversible visual change according to change in temperature. The leuco dye and the reversible color developer can reversibly change between a colored state and a decolored state according to a heating temperature and a cooling speed after heating.

—Leuco Dye—

The leuco dye itself is a colorless or light-colored dye precursor. The leuco dye is not particularly limited and may be appropriately selected from those known in the art. Suitable examples thereof include a triphenylmethane phthalide leuco compound, a triallyl methane leuco compound, a fluoran leuco compound, a phenothiazine leuco compound, a thiofluoran leuco compound, a xanthene leuco compound, an indophthalyl leuco compound, a spiropyran leuco compound, an azaphthalide leuco compound, a couromemopyrazole leuco compound, a methine leuco compound, a rhodamine anilinolactam leuco compound, a rhodamine lactam leuco compound, a quinazoline leuco compound, a diazaxanthene leuco compound, and a bislactone leuco compound. Of these, a fluoran leuco dye and a phthalide leuco dye are particularly preferable from the viewpoints of excellent coloring-decoloring properties, hue, and preservability.

—Reversible Color Developer—

The reversible color developer is not particularly limited and may be appropriately selected depending on the intended purpose, so long as it can be reversibly colored and decolored using heat. Suitable examples thereof include a compound containing at least one of (1) a structure having an ability of coloring the leuco dye (e.g., a phenolic hydroxyl group, a carboxylic acid group, and a phosphoric acid group) and (2) a structure for controlling aggregation force between molecules (e.g., a structure linked with a long-chain hydrocarbon group) in a molecule thereof. Note that, the long-chain hydrocarbon group may be linked via a bivalent or higher linking group containing a hetero atom, and the long-chain hydrocarbon group itself may contain at least one of the linking group as described above and an aromatic group.

The (1) structure having an ability of coloring the leuco dye is particularly preferably a phenolic structure.

The (2) structure for controlling aggregation force between molecules is preferably a long-chain hydrocarbon group having 8 or more carbon atoms, more preferably 11 or more carbon atoms. The long-chain hydrocarbon group has preferably 40 or less carbon atoms, more preferably 30 or less carbon atoms.

The electron-accepting compound (reversible color developer) is preferably used in combination with a compound containing at least one of a —NHCO— group and an —OCONH— group in a molecule thereof as a decoloration accelerator. This is because use of these compounds in combination can induce an intermolecular interaction between the decoloration accelerator and the reversible color developer in the process for shifting toward the decolored state, to thereby improve a coloring and decoloring property.

The decoloration accelerator is not particularly limited and may be appropriately selected depending on the intended purpose.

The thermoreversible recording layer may contain a binder resin and a photothermal converting material; and, if necessary, further contain various additives for improving or controlling coatability or a coloring and decoloring property of the thermoreversible recording layer. Examples of the additives include a surfactant, a conducting agent, filler, an antioxidant, a photostabilizer, a coloring stabilizer, and a decoloring accelerator.

—Binder Resin—

The binder resin is not particularly limited and may be appropriately selected depending on the intended purpose, so long as it can bind the thermoreversible recording layer on the support. Conventionally known resins can be used alone or in combination as the binder resin. Of these, preferable is a resin curable by heat, UV rays, or electron beams from the viewpoint of improvement in durability for repeated use, and particularly preferable is a thermosetting resin cross-linked using an isocyanate compound as a cross-linking agent.

—Photothermal Converting Material—

The photothermal converting material is contained in a thermoreversible recording layer to highly efficiently absorb laser beams to thereby generate heat. The photothermal converting material is added depending on a wavelength of the laser beams.

The photothermal converting material is roughly classified into an inorganic material and an organic material.

Examples of the inorganic material include: carbon black; a metal (e.g., Ge, Bi, In, Te, Se, and Cr) or a semimetal; and alloy thereof. These are shaped in a layered form by a vacuum vapor deposition method or by adhering a particulate material with, for example, a resin.

The organic material may be appropriately selected from various dyes depending on a wavelength of light to be absorbed. In the case where a laser diode is used as a beam source, a near infrared-absorbing pigment having an absorption peak in a wavelength range of from 700 nm through 1,500 nm is used. Specific examples thereof include a cyanine pigment, a quinone pigment, a quinoline derivative of indonaphthol, a phenylene diamine nickel complex, and a phthalocyanine compound. A photothermal converting material being excellent in heat resistance is preferably selected for repeated image processing. In this point of view, the phthalocyanine compound is particularly preferable.

The near infrared-absorbing pigment may be used alone or in combination.

In the case where the photothermal converting layer is disposed, the photothermal converting material is typically used in combination with a resin. The resin used for the photothermal converting layer is not particularly limited and may be appropriately selected from those known in the art, so long as the resin can hold the inorganic material or the organic material. Of these, a thermoplastic resin or a thermosetting resin is preferable. Those usable as a binder resin in the thermoreversible recording layer can be suitably used. Of these, preferable is a resin curable by heat, UV rays, or electron beams from the viewpoint of improvement in durability for repeated use, and particularly preferable is a thermally cross-linkable resin cross-linked using an isocyanate compound as a cross-linking agent.

—First and Second Oxygen Barrier Layers—

The first and second oxygen barrier layers are not particularly limited and may be appropriately selected depending on the intended purpose, so long as they can prevent oxygen from entering the thermoreversible recording layer and prevent photodeterioration of the leuco dye in the thermoreversible recording layer, but preferably respectively disposed on top and bottom surfaces of the thermoreversible recording layer. That is, it is preferable that the first oxygen barrier layer be disposed between the support and the thermoreversible recording layer, and the second oxygen barrier layer be disposed on the second thermoreversible recording layer.

—Protective Layer—

The protective layer is not particularly limited and may be appropriately selected depending on the intended purpose. The protective layer is disposed on the thermoreversible recording layer for the purpose of protecting the thermoreversible recording layer. The protective layer may be provided in one or more layers, but is preferably disposed on an externally exposed outermost surface.

—UV Ray Absorbing Layer—

The UV ray absorbing layer is not particularly limited and may be appropriately selected depending on the intended purpose. The UV ray absorbing layer is preferably disposed on an a surface of the thermoreversible recording layer opposite to a surface where the support is disposed, for the purpose of preventing erasion failure of the leuco dye is in the thermoreversible recording layer resulting from coloration and photodeterioration by the action of UV rays. This can improve light resistance of the recording medium. Preferably, a thickness of the UV ray absorbing layer is appropriately selected so that the UV ray absorbing layer absorbs UV rays of 390 nm or shorter.

—Intermediate Layer—

The intermediate layer is not particularly limited and may be appropriately selected depending on the intended purpose. The intermediate layer is preferably disposed between the thermoreversible recording layer and the protective layer for the purpose of improving adhesion between the thermoreversible recording layer and the protective layer, preventing deterioration of the thermoreversible recording layer due to application of the protective layer, and preventing the additives contained in the protective layer from migrating into the thermoreversible recording layer. This can improve preservability of a colored image. —Under Layer—

The under layer is not particularly limited and may be appropriately selected depending on the intended purpose, so long as it can effectively utilizing applied heat to thereby increase sensitivity, improve adhesion between the support and the thermoreversible recording layer, or prevent permeation of a material contained in the thermoreversible recording layer into the support. For example, the under layer may be disposed between the thermoreversible recording layer and the support. The under layer contains hollow particles and optionally a binder resin; and, if necessary, further contains other components. —Back Layer—

The back layer is not particularly limited and may be appropriately selected depending on the intended purpose. The back layer may be disposed on a surface of the support opposite to a surface where the thermoreversible recording layer is disposed, for the purpose of preventing the thermoreversible recording medium from curling or charging, and improving conveyability of the thermoreversible recording medium. The back layer contains a binder resin; and, if necessary, may further contain other components, such as filler, conductive filler, a lubricant, and a color pigment.

—Adhesive Layer or Bonding Agent Layer—

The adhesive layer or bonding agent layer is not particularly limited and may be appropriately selected depending on the intended purpose. For example, the adhesive layer or bonding agent layer may be disposed on a surface of the support opposite to a surface where the thermoreversible recording layer is disposed, to thereby use the thermoreversible recording medium as a thermoreversible recording label.

(Conveyer Line System)

A conveyor line system according to the present invention includes the image processing apparatus using the thermoreversible recording medium; and, if necessary, further includes other apparatuses.

The conveyor line system is configured to transmit management information of a conveying container to the image processing apparatus for the purpose of managing the conveying container (e.g., returnable container employed in a physical distribution system). When the image processing apparatus receives the management information, the image processing apparatus erases an image on the thermoreversible recording medium attached on the conveying container with laser beams in a non-contact manner and record a new image based on the management information to thereby perform rewriting. This eliminates a need for attaching and peeling off a label. An image on the thermoreversible recording medium is rewritten while moving the conveying container (e.g., a cardboard box and a plastic container) on a belt conveyer. This eliminates a need to stop the line, leading to shortened shipping time.

In the conveyor line system, for example, one sheet of the thermoreversible recording medium is attached on one conveying container and a predetermined number or more of the thermoreversible recording medium (the conveying container) have to be processed per day. Generally, throughput of 1,200 containers or more per hour is required. In other words, one conveying container should be processed for 3.0 seconds or shorter on average. However, out of the 3.0 seconds, it takes 0.6 seconds to convey the conveying container to a position at which laser beams are emitted for erasing and recording an image. Therefore, a period of time actually available for rewriting is 2.4 seconds or shorter per container on average except for the conveying time.

The conveyor line system should satisfy the above requirement for rewriting time and keep quality of an image to be rewritten within an operating temperature in a range of 0° C. or higher but 35° C. or lower.

The conveyor line system is often located in, for example, a platform in a truck terminal exposed to the air, where an ambient temperature tends to be increased to an unexpected level in a short time during the daytime in summer. Additionally, the environment in which an image is erased and recorded with laser beams is shielded by a laser beam shielding cover, so that heat generated from a motor is accumulated within the laser beam shielding cover through continuous operation of a conveyer. Thus, the temperature may be suddenly increased beyond the operation temperature. Specifically, when the recording environmental temperature was measured in summer (August), the temperature was higher than 35° C. in a range of from 1% through 10% of the period of time from Noon (12:00) through 3:00 PM (15:00). Thus, an unexpected high environmental temperature may suddenly be caused for a short time.

The conveyor line system needs to achieve high throughput as described above. Therefore, the time interval between the completion of erasing an image which has been recorded and the beginning of recording a new image is needed to be shortened. However, when the time interval is shortened, a new image should be recorded immediately after the thermoreversible recording medium is irradiated with laser beams to be emitted for erasing an image to accumulate heat. As a result, the thermoreversible recording medium is much less likely to be cooled rapidly.

Therefore, when at least one of the recording environmental temperature and the surface temperature of the thermoreversible recording medium is higher than 35° C., the time interval between the completion of the image erasing step and the beginning of the image recording step may be controlled to be prolonged. Then, the time for dissipating heat generated through emission of the laser beams upon image erasing can be ensured, so that the thermoreversible recording medium is easily cooled rapidly after heating the thermoreversible recording medium with laser beams upon image recording, making it possible to prevent the coloring density from deteriorating and keep quality of an image to be recorded.

Examples of a method for controlling the time interval based on the environmental temperature include (1) a method in which the time interval is controlled for each temperature range and (2) a method in which the time interval is controlled linearly on temperature or controlled in accordance with a mathematical expression. The method (1) is advantageous in that the apparatus and the system can be easily controlled. The method (2) is advantageous in that an effect of prolonged processing time due to suddenly increased temperature can be minimized.

Even when the recording environmental temperature is suddenly increased to higher than 35° C., the rewriting processing time is longer than 2.4 seconds per container only for a short time. Therefore, the rewriting processing time can be kept to 2.4 seconds or shorter per container on average throughout the day can be satisfied by shortening the rewriting processing time at 35° C. or lower to be shorter than 2.4 seconds per container.

An image to be written in the conveyor line system is not particularly limited and may be appropriately selected depending on the intended purpose, so long as it can provide information. Examples of the image include a character, a symbol, a graphic, and an optical information code. Of these, the optical information code is preferably included.

The optical information code is not particularly limited and may be appropriately selected depending on the intended purpose. Examples thereof include a barcode and a QR code (registered trademark). Of these, the image is preferably the barcode in terms of possibility of reading information rapidly.

Note that, in the conveyor line system, in the case where the image includes the barcode, the barcode may be read after the image recording step in order to verify whether the barcode image is properly recorded or whether information included in the barcode is correct.

A barcode image can be evaluated by grading using a method according to ISO 15416 standard. For example, the barcode image can be evaluated using a barcode verifier TRUCHECK TC401RL (manufactured by Webscan Inc.). The barcode image is graded into 5 grades: A, B, C, D, and F based on a numerical value resulted from measuring the barcode image. The best grade is A.

The value in a range of from 3.5 or more but 4.0 or less is determined as grade A, the value in a range of from 2.5 or more but less than 3.5 is determined as grade B, the value in a range of from 1.5 or more but less than 2.5 is determined as grade C, the value in a range of from 0.5 or more but less than 1.5 is determined as grade D, and the value of less than 0.5 is determined as grade F.

In the grades A to C, the barcode image can be unproblematically read by a barcode reader. At the grade D, the barcode image is rarely not be able to be read by the barcode reader with poor readability. At the grade F, the barcode image is frequently not be able to be read by the barcode reader. Therefore, the barcode image preferably has the grade C or greater, in order to ensure stable readability with the barcode reader.

The solid image density can be measured by a portable spectrophotometer X-RITE 939 (manufactured by X-Rite Inc.). In this case, the image density is preferably 1.1 or more, more preferably 1.5 or more from the viewpoint of ensuring a clean image.

<Other Apparatuses>

The other apparatuses is not particularly limited and may be appropriately selected depending on the intended purpose. Examples thereof include a conveyer line configured to convey the conveying container, an image information controller, and an information reader configured to read a formed image.

The conveyor line system according to the present invention is suitable for a physical distribution management system, a delivery management system, a storage management system, and a process management system in a factory.

One exemplary image forming apparatus according to the present invention will now be described referring to figures.

Note that, the number, position, and shape of the following constituent members are not limited to the embodiments described below, and preferable number, position, and shape of the constituent members in the present invention may be used.

FIG. 1 is a schematic diagram illustrating one exemplary image processing apparatus according to the present invention.

In an optical system of the image processing apparatus illustrated in FIG. 1, laser beams emitted by a laser beam source 11 are collimated by a collimator lens 12*b*, enter a diffusing lens 16 serving as the focal length control unit, are concentrated by a condenser lens 18, and then focused on a position that varies depending on a position, in a laser beam emitted direction, of the diffusing lens 16. The diffusing lens 16 is mounted on a lens position control mechanism 17 and is movable in the laser beam emitted direction. The lens position control mechanism 17 is movable at high speed based on pulse motor control, and can control the focal length at high speed.

Figure 2:
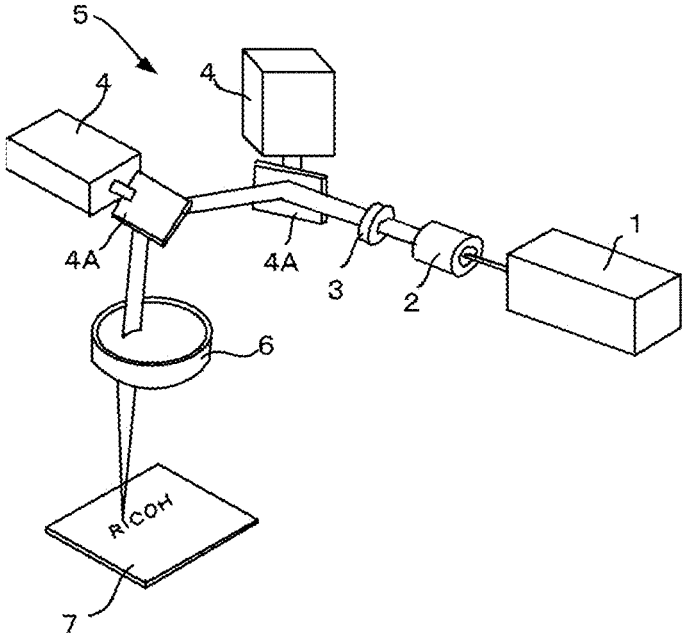
FIG. 2 is a schematic diagram illustrating another exemplary image processing apparatus according to the present invention.

FIG. 2 is a schematic diagram illustrating another exemplary image processing apparatus according to the present invention.

This image processing apparatus illustrated in FIG. 2 includes a laser oscillator 1, a collimator lens 2, a focus position control mechanism 3, a scanning section 5, and a protective glass 6.

The laser oscillator 1 is necessary for obtaining highly directional laser beams having high light intensity. In the case of using the laser oscillator, only laser beams in an optical axis direction are selectively amplified, so that highly directional laser beams are emitted from an emitting power mirror.

The scanning section 5 includes galvanometers 4 and mirrors 4A mounted on the galvanometers 4. The scanning section 5 scans the laser beams emitted from the laser oscillator 1 with two mirrors 4A for the X axis direction and Y axis direction that are mounted on the galvanometer 4 while being rotated at high speed, to thereby perform image recording and image erasing on a thermoreversible recording medium 7.

An image recording and image erasing mechanism now will be described taking as an example a thermoreversible recording medium containing a leuco dye and a reversible color developer referring to FIGS. 3A and 3B.

Figure 3A:
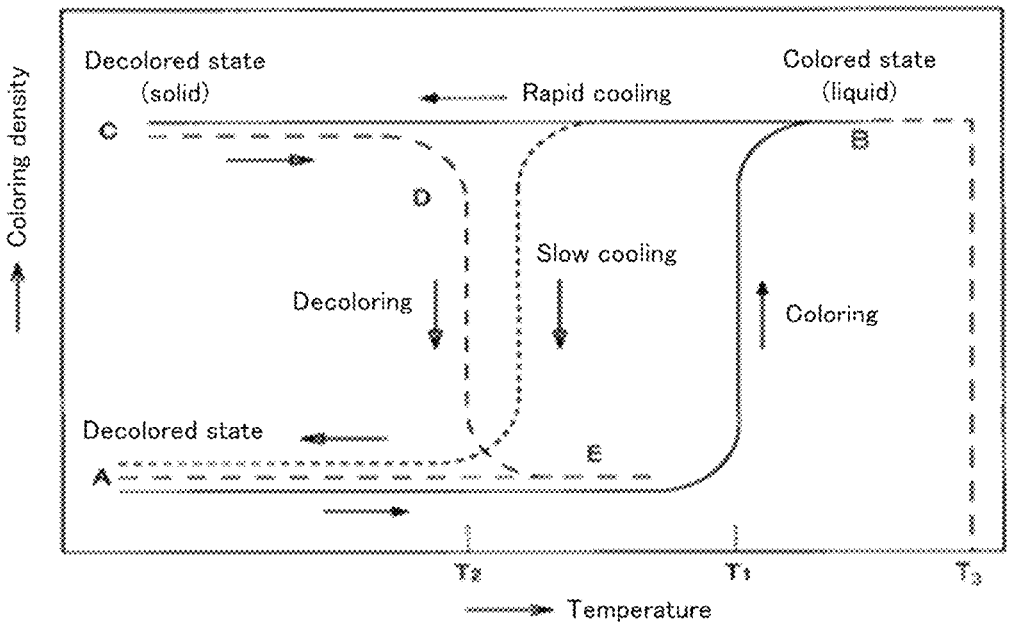
FIG. 3A is a graph illustrating a coloring-decoloring property of a thermoreversible recording medium.
Figure 3B:
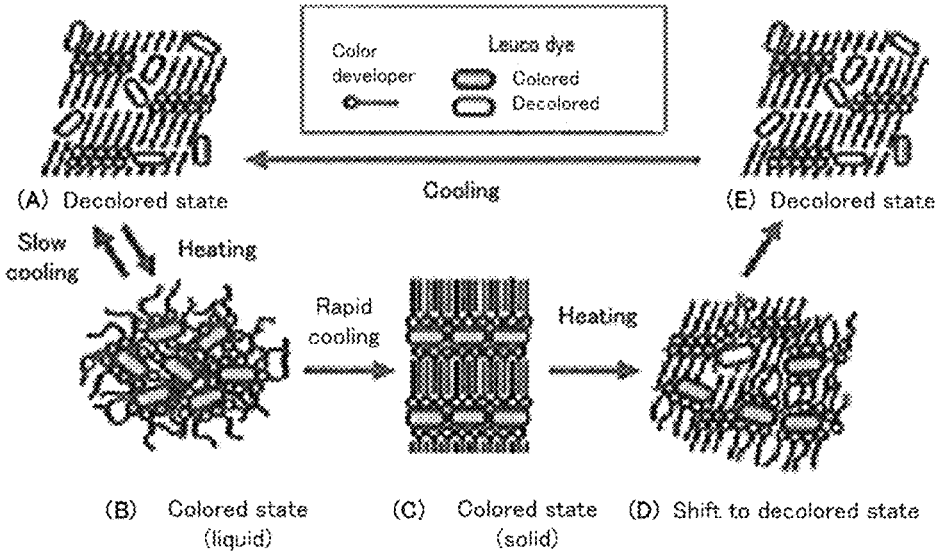
FIG. 3B is a schematic explanatory diagram illustrating a coloring-decoloring mechanism of a thermoreversible recording medium.

FIG. 3A is a graph illustrating a coloring-decoloring property of a thermoreversible recording medium and illustrates one exemplary temperature vs. coloring density change curve of the thermoreversible recording medium that includes a thermoreversible recording layer composed of a resin, and the leuco dye and the reversible color developer contained therein. FIG. 3B is a schematic explanatory diagram illustrating a coloring-decoloring mechanism of a thermoreversible recording medium and illustrates a coloring-decoloring mechanism in which the thermoreversible recording medium reversibly changes between a colored state and a decolored state by the action of heat.

In FIG. 3A, as the recording layer that is initially in a decolored state (A) is heated, the leuco dye and the reversible color developer are melted and mixed with each other at a melting temperature T1, so that the layer develops a color and turns into a melt colored state (B). By cooling rapidly the layer in the melt colored state (B), the layer can be cooled to room temperature while keeping it in the colored state, to thereby turn into a colored state (C) in which the developed color is stabilized. Whether this colored state can be obtained depends on a cooling rate from the melt colored state. In the case of slowly cooling, decoloring occurs in the process of cooling, so that the recording layer turns into the same decolored state (A) as the initial state, or a state in which the color density is relatively lower than that of the colored state (C) obtained through rapid cooling. On the other hand, in the case of heating again from the colored state (C), decoloring occurs (from D to E) at a temperature T2 lower than the coloring temperature. Then, when the layer is cooled from this state, it returns to the decolored state (A) as the initial state.

The colored state (C) obtained through rapid cooling from the melted state is a state in which the leuco dye molecules and the reversible color developer molecules have been mixed so as to be contact and react with each other, where they often form a solid state. In this state, the melted mixture (i.e., colored mixture) of the leuco dye and the reversible color developer has crystallized while being kept in the colored state. This state is believed to stabilize the developed color. On the other hand, a decolored state is a state in which the leuco dye and the developer are phase-separated, where molecules of at least one of the leuco dye and the reversible color developer have aggregated and formed a domain or have crystallized. The leuco dye and the reversible color developer are believed to be separated from each other through the aggregation or crystallization to thereby be stabilized. In many cases, as described above, the leuco dye and the reversible color developer are phase-separated and the reversible color developer is crystallized, leading to more complete decoloring.

In both of decoloring caused by gradual cooling from the melt state and decoloring caused by heating from the colored state, the aggregated structure of the leuco dye and the reversible color developer changes at the temperature T2, resulting in phase separation or crystallization of the reversible color developer.

Further, when the recording layer is repeatedly heated to the temperature T3 equal to or higher than the melting temperature T1, erasion failure may occur to thereby make it impossible to erase an image even after heating to the erasing temperature. This is believed to be because the reversible color developer is thermally decomposed to be less easily aggregable or crystallizable to thereby be less easily separable from the leuco dye. A difference between the melting temperature T1 and the temperature T3 illustrated in FIG. 3A may be decreased upon heating the thermoreversible recording medium to prevent deterioration of the thermoreversible recording medium due to repeated rewriting.

Figure 4:
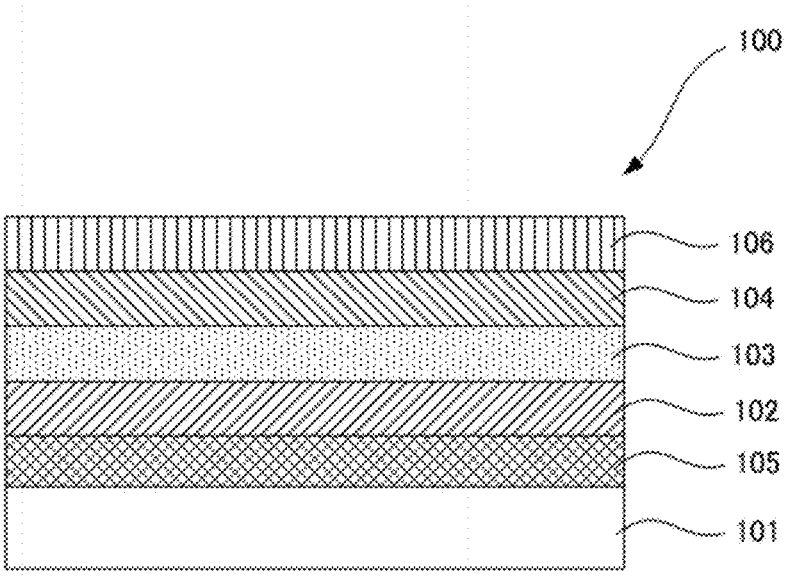
FIG. 4 is a schematic cross-sectional view illustrating one exemplary layer configuration of a thermoreversible recording medium.

FIG. 4 is a schematic cross-sectional view illustrating one exemplary layer configuration of a thermoreversible recording medium.

The layer configuration of the thermoreversible recording medium 100 illustrated in FIG. 4 includes a hollow and a thermoreversible recording layer 102 on (a support member+a first oxygen barrier layer) 101, and further includes an intermediate layer 103, a second oxygen barrier layer 104, and an UV ray absorbing layer 106 in this order on the thermoreversible recording layer.

EXAMPLES

Examples of the present invention now will be described, but the present invention is not limited thereto in any way.

<Conveyer Line System>

In a conveyor line system including an image processing apparatus according to the present example, one sheet of the thermoreversible recording medium is attached on one conveying container. The conveyor line system should process a predetermined number or more of a conveying container (thermoreversible recording medium) per day. Generally, throughput of 1,200 containers or more per hour is required. In other words, one conveying container should be processed for 3.0 seconds or shorter on average. However, out of the 3.0 seconds, it takes 0.6 seconds to convey the conveying container to a position at which laser beams are emitted for erasing and recording an image. Therefore, a period of time actually available for rewriting one conveying container is 2.4 seconds or shorter on average except for the conveying time. Out of the 2.4 seconds, it takes 1.36 seconds for the image erasing step and it takes 0.51 seconds for the image recording step, so that the time interval between the completion of the image erasing step and the beginning of the image recording step should be 0.53 seconds or shorter on average throughout the day.

That is, the time interval may be 0.53 seconds or longer in some periods of time due to sudden increasing of the recording environmental temperature, so long as the rewriting processing time is 2.4 seconds or shorter per container on average throughout the day by setting the time interval to 0.53 seconds or shorter in other periods of time.

For example, when the recording environmental temperature was measured in summer (August), the temperature was higher than 35° C. only in a range of from 1% through 10% of the time from Noon (12:00) through 3:00 PM (15:00). This means that the temperature was suddenly increased for a short time. In the case where the temperature is suddenly increased to an unexpected level (e.g., higher than 35° C.) as described above, the time interval may be set to 0.53 seconds or longer. However, the time interval is set to 0.53 seconds or shorter at a temperature of 35° C. or lower to thereby keep the rewriting processing time of 2.4 seconds or shorter per container on average throughout the day.

<Thermoreversible Recording Medium>

Ricoh rewritable laser medium RLM 100L (50 mm×85 mm) (manufactured by Ricoh Company, Ltd.) was used.

Example 1

As illustrated in FIG. 1, an optical system was formed in which laser beams are emitted from a fiber-coupled laser diode beam source ELEMENT™ E12 (manufactured by nLIGHT Corporation, central wavelength: 976 nm, maximum emitting power: 105 W) serving as the laser beam source 11, collimated by a collimator lens 12*b* disposed in the downstream of an optical path of the emitted laser beams, and then concentrated by the focal length control unit 16 and the condenser lens 18 disposed in the downstream of the collimator lens. Thereafter, a galvanoscanner 6230H (manufactured by Cambridge Inc.) disposed in the downstream side of the optical system scanned the laser beams to irradiate the thermoreversible recording medium with the laser beams, to thereby rewrite an image.

The thermoreversible recording medium was fixed so that the interwork distance from an optical head surface of the fiber-coupled laser diode beam source to the thermoreversible recording medium was 150 mm, and a spot diameter was adjusted with the focal length control unit 16 so that the spot diameter was minimized on the thermoreversible recording medium.

As for an environmental temperature sensor, THERMISTOR 103 ET-1 (manufactured by SEMITEC Corporation) was used.

As for a surface temperature sensor, FT-H30 (manufactured by KEYENCE CORPORATION) was used.

As for a distance sensor, a displacement sensor HL-G112-A-05 (manufactured by Panasonic Industrial Devices SUNX Co., Ltd.) was used.

<Recording Environmental Temperature and Time Interval>

An image was rewritten under the following 4 conditions of the time interval and the recording environmental temperature: 0.1 seconds at 0° C., 0.1 seconds at 25° C., 0.3 seconds at 35° C., and 0.7 seconds at 40° C. Note that, the recording environmental temperature was equivalent to the surface temperature of the thermoreversible recording medium.

<Image Erasing>

An initial condition for image erasing on the thermoreversible recording medium was as described below: erased area: 40 mm×75 mm, scanning velocity Ve: 2,200 mm/s, spot diameter re: 7 mm, pitch width: 1.0 mm, and emitting power Pe settings: 90 W as peak power and 78.0% as pulse width (i.e., power emitted on the thermoreversible recording medium was 70.2 W). This condition was input from an information setting unit in a program section and stored in a memory (not illustrated).

The image erasing was performed with a temperature-based correction of the irradiating energy using the environmental temperature sensor setting to ON. The temperature-based correction of the irradiating energy was performed by determining a correction amount of the pulse width from a temperature difference between a measured temperature value measured by the environmental temperature sensor and the reference temperature of 25° C. using a correction factor of −0.9%/° C. and correcting the emitting power Pe of laser beams based on the correction amount. Specifically, in the case of the measured temperature value of 35° C., the temperature difference from the reference temperature of 25° C. was +10° C., so that the correction amount of the pulse width was determined as −9.0%. Then, laser beams are emitted at the pulse width of 71.0% which was determined by multiplying the setting value of the pulse width at 25° C. of 78.0% by 0.91. The distance sensor was also set to ON.

<Image Recording>

A reference condition for image recording on the thermoreversible recording medium was as described below: recorded area: 50 mm×85 mm, scanning velocity Vw: 4,500 mm/s, spot diameter rw: 0.46 mm, and emitting power Pw settings: 90 W as peak power and 27.0% as pulse width (i.e., power emitted on the thermoreversible recording medium was 24.3 W). This condition was input from the information setting unit in the program section and stored in the memory (not illustrated). As distance information, the interwork distance between a laser beam emitting surface of the laser beam emitting unit and the thermoreversible recording medium of 150 mm was input. The distance sensor was also set to ON.

Based on the reference condition, image recording was performed with the environmental temperature sensor being set to ON and the surface temperature sensor being set to OFF in order to set the erasing environmental temperature as a target to be measured, and the temperature-based correction processing of the irradiating energy being set to ON. The temperature-based correction of the irradiating energy was performed by determining a correction amount of the pulse width from a temperature difference between a measured temperature value and the reference temperature of 25° C. using a correction factor of −0.4%/° C. and correcting the emitting power of laser beams based on the correction amount. Specifically, in the case of the measured temperature value of 35° C., the temperature difference from the reference temperature of 25° C. was +10° C., so that the correction amount of the pulse width was determined as −4.0%. Then, laser beams are emitted at the pulse width of 25.9% which was determined by multiplying the setting value of the pulse width at 25° C. of 27.0% by 0.96.

Figure 5:
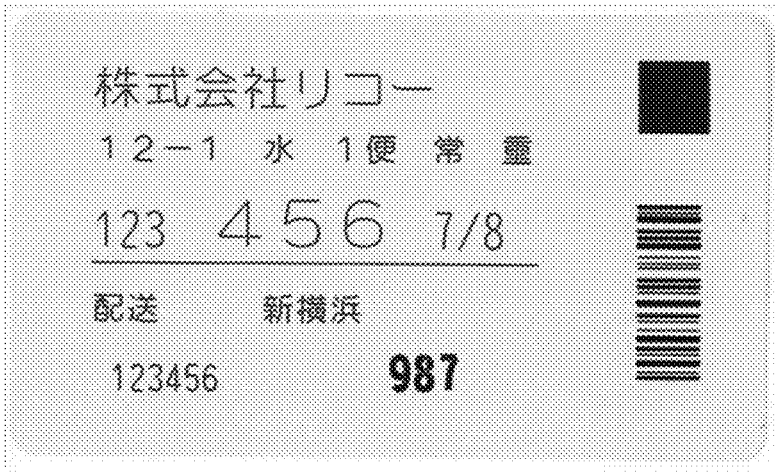
FIG. 5 is a schematic diagram illustrating an evaluated image recorded on a thermoreversible recording medium.

An evaluated image including a barcode image, a solid image (8 mm×8 mm) and a line image as illustrated in FIG. 5 was recorded on the thermoreversible recording medium. Note that, the line image includes all linear images such as a ruled line and a character image.

Then, the barcode image, density of the solid image, and the line image were evaluated and an average processing time per container for a daily operating time was determined in Example 1 as described below. Results are presented in Tables 1-1 and 1-2.

<Evaluation of Barcode Image>

The barcode image was measured according to ISO 15416 standard by the barcode verifier TRUCHECK TC401RL (manufactured by Webscan Inc.) and evaluated according to criteria described below. Note that, in grades D and F, the barcode image is difficult to be practically used.

[Evaluation Criteria]

Grade A: 3.5 or more but 4.0 or less (A: unproblematic readability)

Grade B: 2.5 or more but less than 3.5 (A: unproblematic readability)

Grade C: 1.5 or more but less than 2.5 (A: unproblematic readability)

Grade D: 0.5 or more but less than 1.5 (B: rarely unreadable)

Grade F: less than 0.5 (B: frequently unreadable)

<Evaluation of Density of Solid Image>

The solid image was measured for density by a portable spectrophotometer X-RITE 939 (manufactured by X-Rite Inc.) and visually checked whether the density of the solid image was uniform to thereby evaluate according to criteria described below. In this evaluation, a central portion of the solid image was decreased and ununiformized for the density when the density of the solid image was less than 1.50, and ununiform density was visually confirmed.

[Evaluation Criteria]

A: The density was 1.50 or more and the density of the solid image portion was visually uniform.

B: The density was less than 1.50 and the density of the solid image portion was visually ununiform.

<Evaluation of Line Image>

The line image was visually evaluated according to criteria described below.

[Evaluation Criteria]

A: No blur or fading.

B: Unnoticeable blur or fading.

C: Noticeable blur or fading.

<Evaluation of Throughput>

The target throughput per day can be achieved when the rewriting processing time is 2.4 seconds or shorter per container on average. Therefore, the throughput per day of image rewriting processing was evaluated according to the following criteria.

However, even though the recording environmental temperature is 40° C. and the rewriting processing time is longer than 2.4 seconds per container in some periods of time, the recording environmental temperature is suddenly increased to higher than 35° C. for only a short time. Therefore, the throughput per day is practically unproblematic, so long as the rewriting processing time is shorter than 2.4 seconds per container in the period of time for which the recording environmental temperature is 0° C. or higher but 35° C. or lower.

<Comprehensive Evaluation>

Comprehensive evaluation was performed based on the evaluation results of the barcode image, the density of solid image, and the line image, and the average processing time per container for a daily operating time according to the following criteria. The results are presented in Table 1-2.

[Evaluation Criteria]

A: All of the barcode image, the density of solid image, and the line image were evaluated as A and the average processing time per container for a daily operating time was 2.4 seconds or shorter.

B: Not all of the barcode image, the density of solid image, and the line image were evaluated as A or the average processing time per container for a daily operating time was longer than 2.4 seconds.

Example 2

The barcode image, density of the solid image, and the line image were evaluated and the average processing time per container for a daily operating time was determined in the same manner as in Example 1, except that the surface temperature sensor was set to ON and the environmental temperature sensor was set to OFF in order to set the surface of the thermoreversible recording medium as the target to be measured. Results are presented in Tables 1-1 and 1-2.

Example 3

The barcode image, density of the solid image, and the line image were evaluated and the average processing time per container for a daily operating time was determined in the same manner as in Example 1, except that the time interval at the recording environmental temperature of 35° C. or higher was changed to 0.5 seconds and the pulse width upon image recording was decreased by 2% for correcting the time interval to thereby decrease the irradiating energy of laser beams. Results are presented in Tables 1-1 and 1-2.

Example 4

The barcode image, density of the solid image, and the line image were evaluated and the average processing time per container for a daily operating time was determined in the same manner as in Example 1, except that the time interval at the recording environmental temperature of lower than 32.5° C. was changed to 0.1 seconds and the time interval at the recording environmental temperature of 32.5° C. or higher was linearly varied at a rate of 0.08 seconds/° C. depending on the recording environmental temperature as presented in Table 1-2. Results are presented in Tables 1-1 and 1-2.

Comparative Example 1

The barcode image, density of the solid image, and the line image were evaluated and the average processing time per container for a daily operating time was determined in the same manner as in Example 1, except that the time interval was set to 0.20 seconds independent of the recording environmental temperature. Results are presented in Tables 2-1 and 2-2.

Comparative Example 2

The barcode image, density of the solid image, and the line image were evaluated and the average processing time per container for a daily operating time was determined in the same manner as in Example 1, except that the time interval was set to 0.70 seconds independent of the recording environmental temperature. Results are presented in Tables 2-1 and 2-2.

Comparative Example 3

The barcode image, density of the solid image, and the line image were evaluated and the average processing time per container for a daily operating time was determined in the same manner as in Comparative Example 1, except that the temperature-based correction was set to OFF. Results are presented in Tables 2-1 and 2-2.

Comparative Example 4

The barcode image, density of the solid image, and the line image were evaluated and the average processing time per container for a daily operating time was determined in the same manner as in Example 1, except that the temperature-based correction was set to OFF. Results are presented in Tables 2-1 and 2-2.

Comparative Example 5

The barcode image, density of the solid image, and the line image were evaluated and the average processing time per container for a daily operating time was determined in the same manner as in Example 3, except that the pulse width upon image recording was not varied. Results are presented in Tables 2-1 and 2-2.

TABLE 1-1

| | Measured | | Temperature-based correction | Image quality | |
|---|---|---|---|---|---|
| | Temperature value | Target to be measured | of irradiating energy | Barcode image | Solid image density |
| Ex. 1 | 0° C. | Recording | ON | Grade C A | 1.62 A |
| | 25° C. | environ- | | Grade C A | 1.61 A |
| | 35° C. | ment | | Grade C A | 1.56 A |
| | 40° C | | | Grade C A | 1.54 A |
| Ex. 2 | 0° C. | Thermo- | ON | Grade C A | 1.63 A |
| | 25° C. | reversible | | Grade C A | 1.63 A |
| | 35° C. | recording | | Grade C A | 1.57 A |
| | 40° C | medium | | Grade C A | 1.55 A |
| Ex. 3 | 0° C. | Recording | ON | Grade C A | 1.63 A |
| | 25° C. | environ- | | Grade C A | 1.63 A |
| | 35° C. | ment | | Grade C A | 1.57 A |
| | 40° C | | | Grade C A | 1.50 A |
| Ex. 4 | 0° C. | Recording | ON | Grade C A | 1.63 A |
| | 25° C. | environ- | | Grade C A | 1.63 A |
| | 34° C. | ment | | Grade C A | 1.58 A |
| | 35° C. | | | Grade C A | 1.57 A |
| | 38° C. | | | Grade C A | 1.54 A |
| | 40° C | | | Grade C A | 1.50 A |

TABLE 1-2

| | | Processing time | | | | |
|---|---|---|---|---|---|---|
| | Image quality Line image | Erasing time (second) | Recording time (second) | Time interval (second) | Total (second) | Comprehensive evaluation |
| Ex. 1 | A | 1.36 | 0.51 | 0.10 | 1.97 | A |
| | A | | | 0.10 | 1.97 | |
| | A | | | 0.30 | 2.17 | |
| | A | | | 0.70 | 2.57 | |

TABLE 1-2-continued

| | Image quality Line image | Processing time: Erasing time (second) | Recording time (second) | Time interval (second) | Total (second) | Comprehensive evaluation |
|---|---|---|---|---|---|---|
| Ex. 2 | A | 1.36 | 0.51 | 0.10 | 1.97 | A |
| | A | | | 0.10 | 1.97 | |
| | A | | | 0.30 | 2.17 | |
| | A | | | 0.70 | 2.57 | |
| Ex. 3 | A | 1.36 | 0.51 | 0.10 | 1.97 | A |
| | A | | | 0.10 | 1.97 | |
| | A | | | 0.30 | 2.17 | |
| | A | | | 0.50 (Pulse width change −2%) | 2.37 | |
| Ex. 4 | A | 1.36 | 0.51 | 0.10 | 1.97 | A |
| | A | | | 0.10 | 1.97 | |
| | A | | | 0.22 | 2.09 | |
| | A | | | 0.30 | 2.17 | |
| | A | | | 0.54 | 2.31 | |
| | A | | | 0.70 | 2.57 | |

TABLE 2-1

| | Measured: Temperature value | Measured: Target to be measured | Temperature-based correction of irradiating energy | Image quality: Barcode image | | Image quality: Solid image density | |
|---|---|---|---|---|---|---|---|
| Comp. Ex. 1 | 0° C. | Recording environment | ON | Grade C | A | 1.64 | A |
| | 25° C. | | | Grade C | A | 1.62 | A |
| | 35° C. | | | Grade C | A | 1.48 | B |
| | 40° C | | | Grade D | B | 1 33 | B |
| Comp. Ex. 2 | 0° C. | Recording environment | ON | Grade C | A | 1.63 | A |
| | 25° C. | | | Grade C | A | 1.63 | A |
| | 35° C. | | | Grade C | A | 1.60 | A |
| | 40° C | | | Grade C | A | 1.53 | A |
| Comp. Ex. 3 | 0° C. | — | OFF | Grade D | B | 1.37 | B |
| | 25° C. | | | Grade C | A | 1.63 | A |
| | 35° C. | | | Grade C | A | 1.48 | B |
| | 40° C | | | Grade D | B | 1.22 | B |
| Comp. Ex. 4 | 0° C. | — | OFF | Grade D | B | 1.38 | B |
| | 25° C. | | | Grade C | A | 1.62 | A |
| | 35° C. | | | Grade C | A | 1.51 | A |
| | 40° C | | | Grade C | A | 1.44 | B |
| Comp. Ex. 5 | 0° C. | Recording environment | ON | Grade C | A | 1.63 | A |
| | 25° C. | | | Grade C | A | 1.63 | A |
| | 35° C. | | | Grade C | A | 1.57 | A |
| | 40° C | | | Grade C | A | 1.42 | B |

TABLE 2-2

| | Image quality Line image | Processing time: Erasing time (second) | Recording time (second) | Time interval (second) | Total (second) | Comprehensive evaluation |
|---|---|---|---|---|---|---|
| Comp. Ex. 1 | A | 1.36 | 0.51 | 0.20 | 2.07 | B |
| | A | | | 0.20 | 2.07 | |
| | A | | | 0.20 | 2.07 | |
| | A | | | 0.20 | 2.07 | |
| Comp. Ex. 2 | A | 1.36 | 0.51 | 0.70 | 2.57 | B |
| | A | | | 0.70 | 2.57 | |
| | A | | | 0.70 | 2.57 | |
| | A | | | 0.70 | 2.57 | |

TABLE 2-2-continued

| | Image quality Line image | Processing time: Erasing time (second) | Recording time (second) | Time interval (second) | Total (second) | Comprehensive evaluation |
|---|---|---|---|---|---|---|
| Comp. Ex. 3 | B | 1.36 | 0.51 | 0.20 | 2.07 | B |
| | A | | | 0.20 | 2.07 | |
| | A | | | 0.20 | 2.07 | |
| | A | | | 0.20 | 2.07 | |
| Comp. Ex. 4 | B | 1.36 | 0.51 | 0.10 | 1.97 | B |
| | A | | | 0.10 | 1.97 | |
| | A | | | 0.30 | 2.17 | |
| | A | | | 0.70 | 2.57 | |
| Comp. Ex. 5 | A | 1.36 | 0.51 | 0.10 | 1.97 | B |
| | A | | | 0.10 | 1.97 | |
| | A | | | 0.30 | 2.17 | |
| | A | | | 0.50 (Pulse width change ±0%) | 2.37 | |

From the results in Tables 1-1 and 1-2, it can be seen from Examples 1 and 2, the image quality was able to be kept by controlling the time interval depending on the measured temperature value and the rewriting processing time per container was satisfactorily 2.4 seconds or shorter at the measured temperature value in a range of 0° C. or higher but 35° C. or lower. Note that, although the rewriting processing time was 2.57 seconds per container at the recording environmental temperature of 40° C., the measured temperature value was suddenly increased to higher than 35° C. for only a short time. Therefore, the throughput per day is practically unproblematic. Actually, the measured temperature value was higher than 35° C. for 3% of the daily operating time, which was concentrated from Noon (12:00) through 3:00 PM (15:00), when the system was operated from 8:00 AM to 8:00 PM (20:00) in summer (from July to September) in a customer's factory. The total processing time was determined as 2.19 seconds on average. Therefore, the total processing time was confirmed as practically unproblematic even when a step condition was set so as to ensure the image quality under a high temperature environment in summer in the customer's factory.

It can be seen from Example 3 that, in the case of the measured temperature value of 35° C. or higher, even though the time interval was set to be short (i.e., 0.50 seconds), the image quality was able to be kept, especially in the solid image, the coloring density was able to be kept uniform by decreasing the emitting power of laser beams upon image recording.

It can be seen from Example 4 that prolongation of the processing time was able to be minimized and the average processing time was able to be improved while keeping the image quality by varying the time interval depending on the measured temperature value. Specifically, the total processing time was determined as 1.98 seconds on average when the system was operated in summer in the customer's factory, which is practically unproblematic like Examples 1 and 2, but further shorter than that of Examples 1 and 2.

From the results in Tables 2-1 and 2-2, it can be seen from Comparative Example 1 that, when the time interval was set to be constant in order to achieve satisfactory average processing time per contained for a daily operating time, the image quality was not able to be kept and failure such as reading error of the barcode and poor visibility may occur at the recording environmental temperature of 35° C. or higher.

This may cause misdelivery, potentially making it difficult to stably operate in the physical distribution management system.

It can be seen from Comparative Example 2 that, when the time interval was set to be constant in order to achieve satisfactory image quality, the average processing time per container was not able to be satisfied at all recording environmental temperatures. As a result, satisfactory throughput per day was not able to be achieved, making it difficult to be introduced into the physical distribution management system.

In Comparative Examples 3 and 4, the temperature-based correction of the irradiating energy was set to OFF. Comparing with Comparative Example 1 and Example 1, it can be seen that satisfactory image quality was not able to be achieved at a low recording environmental temperatures.

Comparative Example 5 was evaluated in the same manner as in Example 3, except that the emitting power of laser beams was not varied upon image recording. It can be seen that the coloring density on the solid image was partially decreased, that is, was ununiform since the emitting power was not decreased.

The invention described in Japanese Unexamined Patent Application Publication No. 2008-194905 suggests an image erasing method including a temperature-based correction of irradiating energy, which corresponds to Comparative Examples 1 and 2. In this case, it is believed that the image quality and the throughput are unsatisfactory when the recording environmental temperature is suddenly increased to higher than 35° C.

The invention described in Japanese Unexamined Patent Application Publication No. 11-192737 describes that a medium is cooled using a cooling member in a thermal head device after heating in an erasing step and cooling control is performed by varying a conveying speed of the medium depending on a temperature of the medium. In this thermal head, an erase bar for erasing and a thermal head for recording are fixed, so that the medium is controlled to be cooled based on settings of the conveying speed and the temperature of the cooling member. However, when the conveying speed is controlled, conditions for erasing and recording should be varied depending on the conveying speed. Meanwhile, the image processing method of the present invention is a method in which an image is rewritten with laser beams in a non-contact manner, so that the cooling member cannot be set and the conditions for erasing and recording are independent on the conveying speed. Therefore, the present invention is not highly related to the invention described in Japanese Unexamined Patent Application Publication No. 11-192737.

Note that, in Example 1, the image processing apparatus was incorporated into the conveyer system. The barcodes were rewritten at the recording environmental temperatures and the erasing environmental temperatures of 0° C., 25° C., 35° C., and 40° C. and then read, which was repeated 3,000 times. As a result, it was confirmed that the barcodes were able to be read at all conditions described above.

Aspects of the present invention are as follows:

<1> An image processing method including:

heating a thermoreversible recording medium with laser beams to erase an image which has been recorded on the thermoreversible recording medium, the thermoreversible recording medium reversibly changing between a colored state and a decolored state depending on a heating temperature and a cooling time;

heating the thermoreversible recording medium, on which the image has been erased, with the laser beams to record a subsequent image on the thermoreversible recording medium; and measuring at least one of a surface temperature of the thermoreversible recording medium and a recording environmental temperature after a completion of erasing the image but before a beginning of recording the subsequent image to obtain a measured temperature value and controlling a time interval between the completion of erasing the image and the beginning of recording the subsequent image depending on the measured temperature value.

<2> The image processing method according to <1>, wherein the controlling further includes controlling emitting power of the laser beams to be emitted for recording the subsequent image on the thermoreversible recording medium depending on the measured temperature value.

<3> The image processing method according to <1> or <2>, wherein the controlling further includes controlling the emitting power of the laser beams to be emitted for recording the subsequent image on the thermoreversible recording medium depending on the time interval between the completion of erasing the image and the beginning of recording the subsequent image.

<4> The image processing method according to any one of <1> to <3>, wherein the image and the subsequent image include an optical information code.

<5> The image processing method according to <4>, wherein the optical information code includes a barcode.

<6> An image processing apparatus including:

a laser beam emitting unit configured to irradiate a thermoreversible recording medium with laser beams to heat the thermoreversible recording medium, to perform at least one of erasing an image which has been recorded on the thermoreversible recording medium and recording an image on the thermoreversible recording medium, the thermoreversible recording medium reversibly changing between a colored state and a decolored state depending on a heating temperature and a cooling time;

a laser beam scanning unit configured to scan the laser beams to perform at least one of erasing the image which has been recorded on the thermoreversible recording medium and recording an image on the thermoreversible recording medium; and a control unit configured to measure at least one of a surface temperature of the thermoreversible recording medium and a recording environmental temperature after a completion of erasing the image but before a beginning of recording the subsequent image to obtain a measured temperature value and control a time interval between the completion of erasing the image and the beginning of recording the subsequent image depending on the measured temperature value.

<7> The image processing apparatus according to <6>, wherein the image processing apparatus includes a focal length control unit, the focal length control unit including a lens system, which is disposed between the laser beam emitting unit and the laser beam scanning unit, configured to be able to adjust a focal point of the laser beams, the focal length control unit being configured to control a position of the lens system so as to defocus on a position of the thermoreversible recording medium upon image erasing and so as to focus on a position of the thermoreversible recording medium upon image recording.

<8> The image processing apparatus according to <6> or <7>, wherein the laser beam emitting unit includes a laser beam source, the laser beam source being a fiber-coupled laser diode which is configured to emit laser beams having a wavelength in a range of 700 nm or longer but 1,600 nm or shorter.

<9> The image processing apparatus according to any one of <6> to <8>, wherein the laser beams are emitted for erasing the image at emitting power in a range of from 5 W or more but 200 W or less.

<10> The image processing apparatus according to any one of <6> to <9>, wherein the laser beams are emitted for erasing the image at scanning velocity in a range of from 100 mm/s or more but 20,000 mm/s or less.

<11> The image processing apparatus according to any one of <6> to <10>, wherein the laser beams are emitted for erasing the image at a spot diameter in a range of from 1 mm or more but 20 mm or less.

<12> The image processing apparatus according to any one of <6> to <11>, wherein the laser beams are emitted for recording the subsequent image at the emitting power in a range of from 1 W or more but 200 W or less.

<13> The image processing apparatus according to any one of <6> to <12>, wherein the laser beams are emitted for recording the subsequent image at the scanning velocity in a range of from 300 mm/s or more but 15,000 mm/s or less.

<14> The image processing apparatus according to any one of <6> to <13>, wherein the laser beams are emitted for recording the subsequent image at the spot diameter in a range of from 0.02 mm or more but 2.0 mm or less.

<15> The image processing apparatus according to any one of <6> to <13>, wherein the laser beams are scanned a pitch width in a range of 0.3 mm or more but 6 mm or less.

<16> A conveyor line system including the image processing apparatus according to any one of <6> to <15>.

The image processing method according to any one of <1> to <5>, the image processing apparatus according to any one of <6> to <15>, and the conveyor line system according to <16> can solve the existing problems and achieve the object of the present invention.

What is claimed is:

1. An image processing method comprising:

heating a thermoreversible recording medium with laser beams to erase an image which has been recorded on the thermoreversible recording medium, the thermoreversible recording medium reversibly changing between a colored state and a decolored state depending on a heating temperature and a cooling time;

heating the thermoreversible recording medium, on which the image has been erased, with the laser beams to record a subsequent image on the thermoreversible recording medium; and measuring at least one of a surface temperature of the thermoreversible recording medium and a recording environmental temperature after a completion of erasing the image but before a beginning of recording the subsequent image to obtain a measured temperature value and controlling a time interval between the completion of erasing the image and the beginning of recording the subsequent image depending on the measured temperature value.

2. The image processing method according to claim 1, wherein the method further comprises controlling emitting power of the laser beams to be emitted for recording the subsequent image on the thermoreversible recording medium depending on the measured temperature value.

3. The image processing method according to claim 1, wherein the method further comprises controlling emitting power of the laser beams to be emitted for recording the subsequent image on the thermoreversible recording medium depending on the time interval.

4. The image processing method according to claim 1, wherein the image and the subsequent image comprise an optical information code.

5. The image processing method according to claim 4, wherein the optical information code comprises a barcode.

6. An image processing apparatus comprising:

a laser beam emitting unit configured to irradiate a thermoreversible recording medium with laser beams to heat the thermoreversible recording medium, to perform at least one of erasing an image which has been recorded on the thermoreversible recording medium and recording an image on the thermoreversible recording medium, the thermoreversible recording medium reversibly changing between a colored state and a decolored state depending on a heating temperature and a cooling time;

a laser beam scanning unit configured to scan the laser beams to perform at least one of erasing the image which has been recorded on the thermoreversible recording medium and recording an image on the thermoreversible recording medium; and a control unit configured to measure at least one of a surface temperature of the thermoreversible recording medium and a recording environmental temperature after a completion of erasing the image but before a beginning of recording the subsequent image to obtain a measured temperature value and control a time interval between the completion of erasing the image and the beginning of recording the subsequent image depending on the measured temperature value.

7. The image processing apparatus according to claim 6, wherein the image processing apparatus comprises a focal length control unit, the focal length control unit comprising a lens system, which is disposed between the laser beam emitting unit and the laser beam scanning unit, configured to be able to adjust a focal point of the laser beams, the focal length control unit being configured to control a position of the lens system so as to defocus on a position of the thermoreversible recording medium upon image erasing and so as to focus on a position of the thermoreversible recording medium upon image recording.

8. The image processing apparatus according to claim 6, wherein the laser beam emitting unit comprises a laser beam source, the laser beam source being a fiber-coupled laser diode which is configured to emit laser beams having a wavelength in a range of 700 nm or longer but 1,600 nm or shorter.

9. The image processing apparatus according to claim 6, wherein the laser beams are emitted for erasing the image at emitting power in a range of from 5 W or more but 200 W or less.

10. The image processing apparatus according to claim 6, wherein the laser beams are emitted for erasing the image at scanning velocity in a range of from 100 mm/s or more but 20,000 mm/s or less.

11. The image processing apparatus according to claim 6, wherein the laser beams are emitted for erasing the image at a spot diameter in a range of from 1 mm or more but 20 mm or less.

12. The image processing apparatus according to claim 6, wherein the laser beams are emitted for recording the subsequent image at emitting power in a range of from 1 W or more but 200 W or less.

13. The image processing apparatus according to claim 6, wherein the laser beams are emitted for recording the subsequent image at scanning velocity in a range of from 300 mm/s or more but 15,000 mm/s or less.

14. The image processing apparatus according to claim 6, wherein the laser beams are emitted for recording the subsequent image at a spot diameter in a range of from 0.02 mm or more but 2.0 mm or less.

15. The image processing apparatus according to claim 6, wherein the laser beams are scanned a pitch width in a range of 0.3 mm or more but 6 mm or less.

16. A conveyor line system comprising an image processing apparatus, the image processing apparatus comprising:

a laser beam emitting unit configured to irradiate a thermoreversible recording medium with the laser beams to heat the thermoreversible recording medium, to perform at least one of erasing an image which has been recorded on the thermoreversible recording medium and recording an image on the thermoreversible recording medium, the thermoreversible recording medium reversibly changing between a colored state and a decolored state depending on a heating temperature and a cooling time;

a laser beam scanning unit configured to scan the laser beams to perform at least one of erasing the image which has been recorded on the thermoreversible recording medium and recording an image on the thermoreversible recording medium; and a control unit configured to measure at least one of a surface temperature of the thermoreversible recording medium and a recording environmental temperature after a completion of erasing the image but before a beginning of recording the subsequent image to obtain a measured temperature value and control a time interval between the completion of erasing the image and the beginning of recording the subsequent image depending on the measured temperature value.

* * * * *